United States Patent [19]

Fritz et al.

[11] Patent Number: 4,930,268

[45] Date of Patent: Jun. 5, 1990

[54] APPARATUS FOR ASSEMBLING A ROOF FRAME WITH A POST, FOR MAKING FRAMEWORK AND STRUCTURES

[75] Inventors: Andre Fritz, Beinheim; Jean Gerlinger, Geudertheim, both of France

[73] Assignee: Bator S.A., Societe Anonyme, Reichstett, France

[21] Appl. No.: 224,704

[22] Filed: Jul. 27, 1988

[30] Foreign Application Priority Data

Jul. 27, 1987 [FR] France ..... 87 10718

[51] Int. Cl.[5] ..... E04B 7/02

[52] U.S. Cl. ..... 52/90; 52/639

[58] Field of Search ..... 52/90, 93, 639, 641; 403/252, 263

[56] References Cited

U.S. PATENT DOCUMENTS

| | | | |
|---|---|---|---|
| 3,255,769 | 6/1966 | Lloyd . | |
| 3,310,917 | 3/1967 | Simon | 52/90 |
| 3,786,612 | 1/1974 | Baker | 52/639 X |
| 4,296,576 | 10/1961 | Rile, Jr. et al. | 52/90 |
| 4,299,509 | 11/1981 | Meickl | 403/252 |
| 4,594,822 | 6/1986 | Marschak | 52/90 |

FOREIGN PATENT DOCUMENTS

| | | |
|---|---|---|
| 1151201 | 1/1958 | France . |
| 2352202 | 12/1977 | France . |
| 2588586 | 4/1987 | France . |
| WO86/04104 | 7/1986 | Int'l Pat. Institute . |

*Primary Examiner*—David A. Scherbel
*Assistant Examiner*—Creighton Smith
*Attorney, Agent, or Firm*—Young & Thompson

[57] ABSTRACT

Assembly device for a roof frame having an inclined roof beam, with a post, for making framework and structures, characterized in that it consists of two cast members (1 and 2), one (1) being disposed fixedly in the interior of the lower end of the roof beam (3), and the other (2) being disposed fixedly partially within the interior of the upper end of the post (4). The two members have structure (5, 6, 7, 8) securing them together at two spaced locations, the distance between these locations being greater than the width of the post (4), the two members (1 and 2) coacting to ensure assembly and securement of the roof beam (3) with the post (4) by mere engagement of the securing structure (5, 6, 7, 8). One of the members (1, 2) comprises two recesses (5 and 6) and the other of the members (1, 2) two lugs (7 and 8), the assembly of the roof beam (3) with the post (4) taking place solely by insertion of the two lugs (7 and 8) in the two recesses (5 and 6).

10 Claims, 3 Drawing Sheets

APPARATUS FOR ASSEMBLING A ROOF FRAME WITH A POST, FOR MAKING FRAMEWORK AND STRUCTURES

The present invention relates to apparatus for assembling a roof frame with a post, for the production of framework, and more generally of structures.

At present, for the production of a framework or of a structure, the assembly of the roof frame with each support post can be effected only with different securement elements such as bolts, dowels, screws, pins, etc., and with uncast connection members.

It is therefore necessary, to effect such an assembly, to resort to a full set of tools and, if needed, to effect this operation with several workers, so as to position exactly the connection members simultaneously on the roof beam and on the post. Such assembly therefore requires considerable time and investment in material and a relatively large number of people. Moreover, the connection members increase the weight of the framework or of the structure, as well as its volume, the connecting members being only partially enclosed within the frame beam or in the post, which gives rise to problems not only of storage but of shipping. Moreover, it happens that upon assembly, certain connecting or other members will be defective, which inevitably involves loss of time, and very often problems of security, because often the assemblers, in order to work quickly, will replace a defective piece with a piece designed for another use.

The overall problem to be resolved by the object of the present application, is to provide an assembly apparatus in which neither any connecting member nor any securement member is required. Moreover, this apparatus should be lighter and as small as possible (so as to provide easy storage and shipping), while having adequate safety during erection, each roof beam of the frame being generally assembled with the post on the ground, the assembly then being raised.

Such a device should permit a single person to effect the assembly of the roof beam with each post with no tools (thus without risk of loss, simplification, savings of material . . .), and with no connecting member to be secured during assembly so as to render the assembly more secure, to obtain simplification of mounting as well as a substantial saving of time. Finally, all these parameters coact, of course, to render such a mode of assembly much more economical than the known modes of assembly.

According to the present invention, the assembly device for a roof frame with a post, for producing framework and structures, is characterized in that it consists of two cast pieces, one being disposed, in a fixed manner, within the interior of the lower end of the roof beam, and the other being disposed, in a fixed manner, partially in the interior of the upper end of the post, the two pieces coacting with each other so as to ensure the assembly and the securement of the roof beam with the post by mere insertion.

The invention will be better understood thanks to the following description, which relates to a preferred embodiment, given by way of non-limiting example, and explained with reference to the accompanying schematic drawings, in which.

Figure 3:
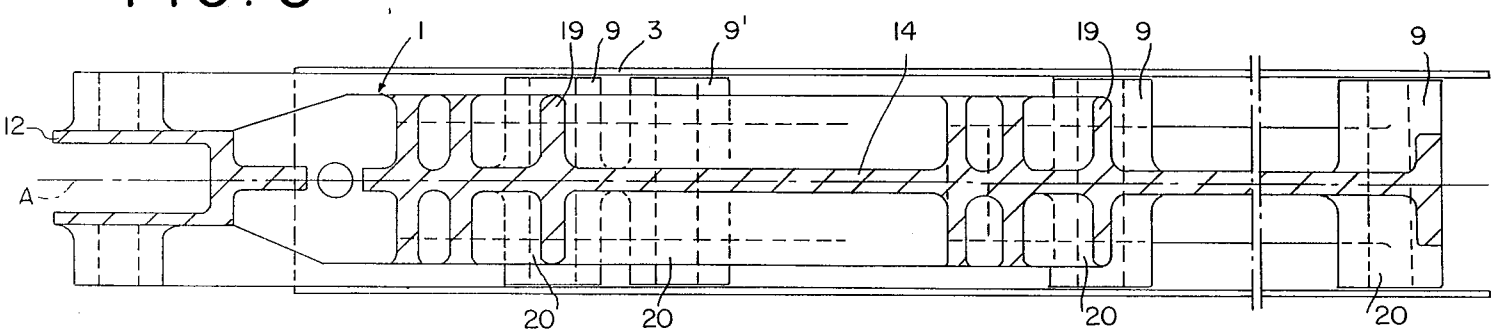
FIG. 3 is a sectional view on a larger scale than FIG. 2, and on the line 3—3 of FIG. 2.
Figure 2:
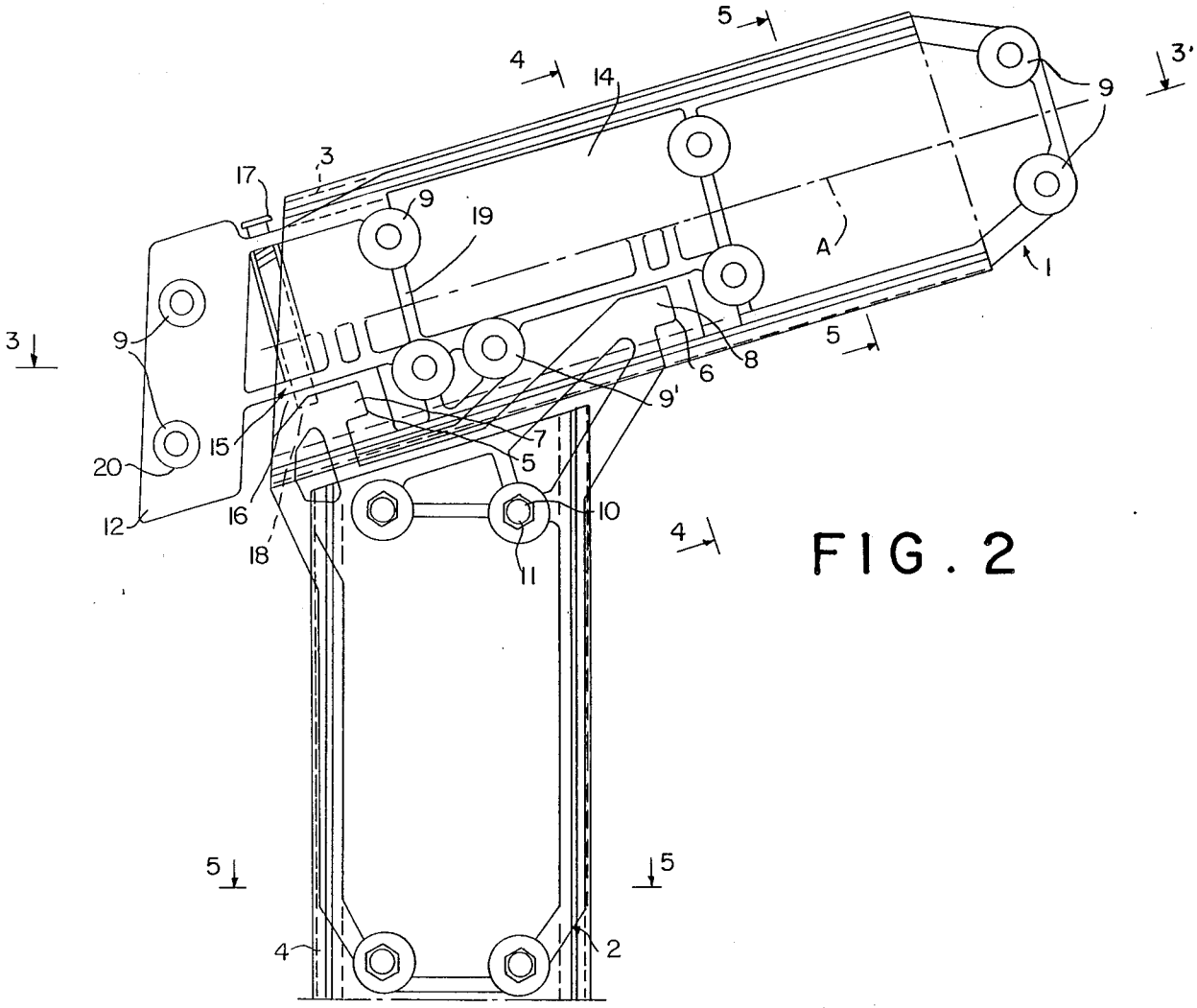
FIG. 2 is an elevational view on a larger scale than FIG. 1, of an assembly device according to the invention and connecting a roof beam with a post.
Figure 5:
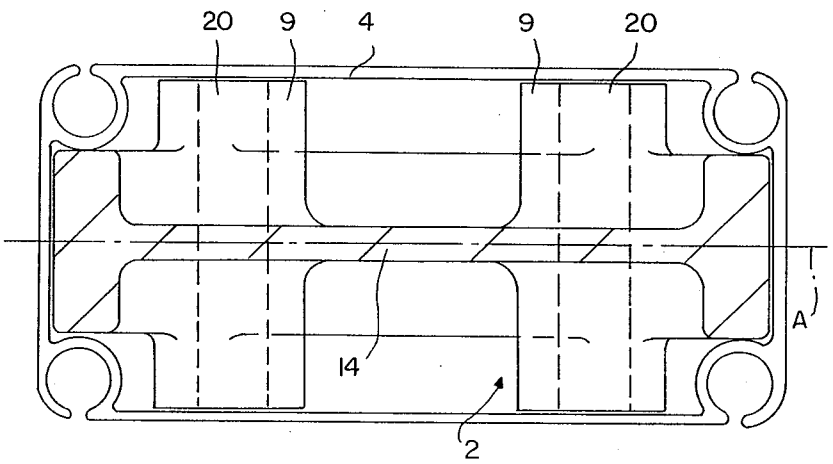
Figure 4:
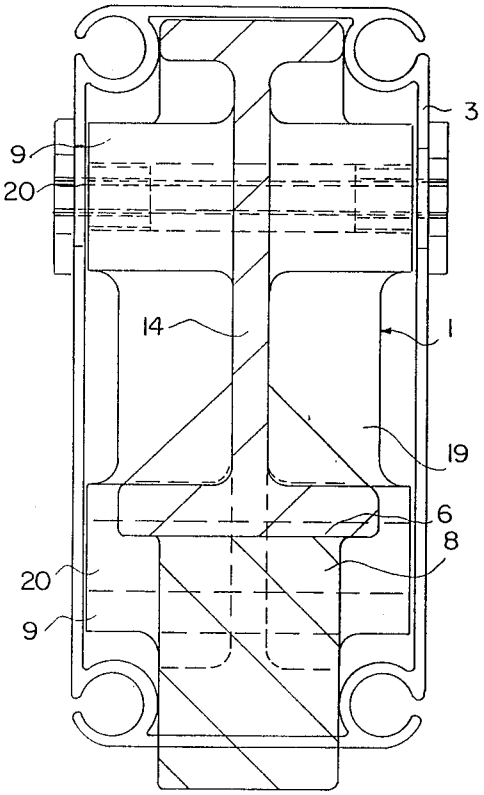

FIG. 4 is a sectional view, on the same scale as FIG. 3, and on the line 4—4 of FIG. 2, and FIG. 5 is a sectional view, on the same scale as FIGS. 3 and 4, and on the line 5—5 of FIG. 2.

According to the invention, the assembly device consists of two cast members 1 and 2, one being disposed fixedly in the interior of the lower end of the roof beam 3, and the other 2 being fixedly disposed partially in the interior of the upper end of post 4, the two pieces 1 and 2 coacting so as to ensure the assembly of the securement of the roof beam 3 to the post 4 by mere insertion.

According to a first characteristic of the invention, the cast piece 1 comprises two recesses 5 and 6, and the cast piece 2 two lugs 7 and 8, the assembly of the roof beam 3 with the post 4 being effectuated merely by insertion of the two lugs 7 and 8 in the two recesses 5 and 6.

As can be seen in FIG. 2, the inserted assembly of lug 7 in recess 5 is separated from the other inserted assembly of lug 8 in recess 6 by a distance greater than the width of post 4.

This permits providing optimum rigidity and strength for each assembly.

According to FIGS. 2 to 5, each cast member 1 or 2 comprises various bosses 9 permitting maintaining the cast members 1 and 2 in the roof beam 3 or the post 4, the length of these bosses 9 corresponding substantially to the thickness of the roof beam 3 or of the post 4. These bosses 9 serve to support a securement assembly, for example, screw 10-nut 11, the screw 10 passing through the boss 9, by an opening 20, these bosses 9 being moreover interconnected by a web 14 located in the plane perpendicular to the central axes of bosses 9 and passing through the axis of symmetry A of each cast piece 1 or 2, and by ribs 19 located, for example, in the plane passing through the central axes of the bosses 9.

Initially therefore, for example immediately after the fabrication of the roof beams 3 and the posts 4, one can insert in the interior of the upper end of each post 4, a cast piece 2 and in the interior of the lower end of each roof beam 3 a cast piece 1. Then these cast pieces and 2 will be secured to the respective interior of each roof beam 3 and each post 4 by any known means such as bolts, dowels, screws, pins, etc.

For use of the roof beams 3 and posts 4, these will therefore already be provided with cast members 1 and 2.

For assembly, it is therefore necessary only to insert the lugs 7 and 8 in the recesses 5 and 6 of the two cast members 1 and 2. This is made possible thanks to an opening provided at the lower end of the roof beam 3.

Such an assembly suffices to render the operation of erecting the assembled frame on the ground, completely safe, the distance separating the two insertion assemblies being sufficient to ensure complete stability of the assembly and the bosses 9 absorbing substantially all of the force during the erection operation itself.

Moreover, it can be seen that the cast member 1 is entirely disposed within the interior of the roof beam 3, the cast piece 2 itself being similarly disposed substantially along all of its length, except that the upper end of the cast piece 2 extends slightly beyond the post 4. Such a structure has the advantage of being able to be stored and transported very easily.

Finally, the structure of the cast members 1, 2 itself (web 14, ribs 19) has been conceived so as to obtain cast pieces 1, 2 as light as possible. These could well be of light alloy, for example of aluminum.

According to a modification of the invention, and as shown in FIG. 2, the cast piece 1 could be provided, at one of its ends, with a strap 12 permitting the securement if desired of a prolongation 13 of the roof beam 3 by any known means, such as assemblies of screw 10-nut 11, each screw 10 being thus supported by a boss 9 located on the strap 12.

Figure 1:
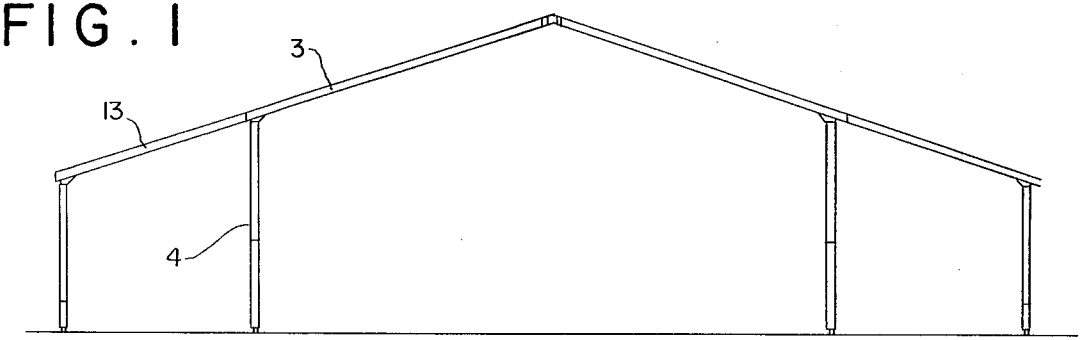
FIG. 1 is an elevational view of a structure composed of a frame and various support posts.

Such a strap 12 permits, in case of the extension of a building, to extend the roof beam 3, this extension 13 of course being adapted itself to be provided at its other end with a cast piece 1 permitting its assembly to a beam 4 (see FIG. 1 of the accompanying drawings).

Moreover, it can also be provided that within this strap 12 slides a tensioning system for tarpaulins from one frame to the other.

According to a second modification of the invention, and as also shown in FIG. 2, the assembly device may moreover be provided with an automatic securement device 15, in the form of a lug 16 mounted on spring 17 located on the cast member 1, and coacting with a recess 18 located on the cast member 2.

The spring 17 permits ensuring automatic locking as soon as the lug 13 enters the recess 18 of the cast member 2.

Finally, and according to a third modification of the invention, the cast member 1 may be provided with a boss 9' whose central axis is parallel to the other bosses 9 and permitting the passage of cables for shuttering (FIG. 2).

Of course, the invention is not limited to the embodiment described and shown in the accompanying drawings. Modifications remain possible, particularly from the standpoint of the construction of various elements, or by substitution of technical equivalents, without thereby departing from the scope of protection of the invention.

We claim:

1. Assembly device for a roof frame having a hollow inclined roof beam, with a hollow post, for making framework and structures, characterized in that it consists of two cast members (1 and 2) separate from the hollow roof beam and the hollow post, one (1) being disposed fixedly in the interior of the lower end of the hollow roof beam (3), and the other (2) being disposed fixedly partially within the interior of the upper end of the hollow post (4), the two members having means (5, 6, 7, 8) securing them together at two spaced locations, the distance between said locations being greater than the width of the post (4), the two members (1 and 2) coacting to ensure assembly and securement of the roof beam (3) with the post (4) by mere engagement of said securing means (5, 6, 7, 8).

2. Apparatus according to claim 1, characterized in that one of said members (1, 2) comprises two recesses (5 and 6) and the other of said members (1, 2) two lugs (7 and 8), the assembly of the roof beam (3) with the post (4) taking place solely by insertion of the two lugs (7 and 8) in the two recesses (5 and 6).

3. Apparatus according to claim 1, characterized in that each cast member (1 or 2) comprises various bosses (9) permitting maintaining the cast members (1 and 2) in the roof beam (3) or the post (4), the length of these bosses (9) corresponding substantially to the thickness of the roof beam (3) or of the post (4) and the bosses (9) serving to support a securement assembly, (10, 11) - nut (11), the screw (10) passing through the boss (9) by an opening (20), these bosses (9) being moreover interconnected by a web (14) situated in the plane perpendicular to the central axes of the bosses (9) and passing through the axis of symmetry (A) of each cast member (1 or 2), and by ribs (19) in the plane passing through the central axes of the bosses (9).

4. Apparatus according to claim 1, characterized in that the cast member (1) is provided at one of its ends with a strap (12) permitting the securement of a prolongation (13) of the roof beam (3) by securement means (10, 11) thus supported by a boss (9) located on the strap (12).

5. Apparatus according to claim 1, characterized in that it is moreover provided with an apparatus for automatic locking (15).

6. Apparatus according to claim 5, characterized in that the locking apparatus (15) is in the form of a lug (16) mounted on spring (17) located on the cast member (1), and coacting with a recess (18) located on the cast member (2).

7. Apparatus according to claim 1, characterized in that a said cast member (1) is provided moreover with a boss (9') whose central axis is parallel to other bosses (9) by which said cast members (1, 2) are secured to said roof beam (3) and post (4), respectively, the first-mentioned boss (9') permitting the passage of shuttering cables.

8. Apparatus according to claim 1, characterized in that the cast members (1 and 2) are of a light alloy.

9. Apparatus according to claim 8, characterized in that the cast members (1 and 2) are of aluminum.

10. Apparatus according to claim 2, characterized in that said one member (1) is disposed in said roof beam (3) and said other member (2) is disposed partially within said post (4).

* * * * *